US009604833B1

(12) United States Patent
Waddell

(10) Patent No.: US 9,604,833 B1
(45) Date of Patent: Mar. 28, 2017

(54) POWER ASSIST FOR MANUAL CAN OPENER

(71) Applicant: John L. Waddell, Redmond, WA (US)

(72) Inventor: John L. Waddell, Redmond, WA (US)

( * ) Notice: Subject to any disclaimer, the term of this patent is extended or adjusted under 35 U.S.C. 154(b) by 262 days.

(21) Appl. No.: 14/257,858

(22) Filed: Apr. 21, 2014

Related U.S. Application Data

(60) Provisional application No. 61/813,943, filed on Apr. 19, 2013.

(51) Int. Cl.
*B67B 7/00* (2006.01)
*B67B 7/46* (2006.01)

(52) U.S. Cl.
CPC ..... *B67B 7/385* (2013.01); *B67B 7/30* (2013.01); *B67B 2007/303* (2013.01)

(58) Field of Classification Search
CPC .. B25B 27/00; B67B 7/44; B67B 7/38; B67B 2007/303; B67B 7/30; B67B 7/385
USPC ..... 81/3.09; 30/422
See application file for complete search history.

(56) References Cited

U.S. PATENT DOCUMENTS 970,371 A * 9/1910 Greggs ..... B25B 13/48 81/176.2
3,075,285 A 1/1963 Desjardins
4,357,845 A 11/1982 Cornia
D282,521 S * 2/1986 Steinko ..... D8/39
4,984,489 A * 1/1991 Krauthamer ..... B25B 13/48 81/121.1
5,289,638 A * 3/1994 Chase ..... B67B 7/385 30/417
5,433,850 A 7/1995 Murray
D379,420 S 5/1997 Standlee
D397,596 S 9/1998 Morin
6,010,154 A 1/2000 Payne
6,294,719 B1 9/2001 Palecki
6,408,520 B1 * 6/2002 Ridler ..... A47J 17/10 30/123.6
6,729,210 B2 5/2004 Morris
D594,305 S 6/2009 Gyder
2004/0050218 A1 3/2004 Napoli
2004/0099104 A1 * 5/2004 Pearson ..... B25B 13/5091 81/176.15

FOREIGN PATENT DOCUMENTS

DE 40 09 398 A1 9/1991

* cited by examiner

*Primary Examiner* — Hadi Shakeri
(74) *Attorney, Agent, or Firm* — Christensen O'Connor Johnson Kindness PLLC

(57) ABSTRACT

A power assist unit (70) to rotate the twist knob (50) of a typical manual can opener (20) includes a coupling head (72) that is rotated or powered by a hand-held power unit (74). The coupling head includes an elongated crossbar (76) connected at its center to a torque shaft (78) that projects outwardly from the head portion (80) of the power unit. Parallel engagement pins (82) project from the crossbar (76) to bear against opposite sides of the twist knob (50) for rotation of the twist knob.

9 Claims, 15 Drawing Sheets

POWER ASSIST FOR MANUAL CAN OPENER

BACKGROUND

The present invention pertains to a portable hand-held power assist unit for turning the knob of a manual can opener. The power assist unit has a universal coupling head to engage virtually any type of manual can opener being sold.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

A manual can opener operated by a twist knob is powered by a torque source rather than having to turn the twist knob by hand. A coupling head is interposed between the twist knob of the can opener and the torque source. The coupling head includes a base member to overlie at least a portion of the twist knob as well as one or more engagement members that project generally laterally from the base member to engage with portions of the twist knob so as to force rotation of the twist knob during application of torque from the torque source. A drive shaft projects from the base member in a direction opposite to the one or more engagement members. The drive shaft is capable of receiving torque from the torque source to rotate the coupling head to in turn rotate the twist knob with the can opener.

The one or more engagement members may consist of a pair of pins that project from the base members. The pins are spaced apart far enough to enable the pins to bear against opposite sides of the twist knob for rotation of the twist knob. The drive shaft is positioned centrally between the pins, and the distance that the pins project from the base member may be selectively varied.

In a further aspect of the present disclosure, the engagement member(s) that project from the base member can correspond to the shape of at least a portion of the outer perimeter of the twist knob. In this regard, the engagement member may be shaped to extend around the outer perimeter of the twist knob.

In accordance with a further aspect of the present disclosure, the drive shaft is configured to receive a drive socket or other torque connector. The drive shaft can be of various shapes, including triangular, rectangular, square, pentagonal, hexagonal, oval, partially circular, etc.

In a further aspect of the present disclosure, the torque source used to power the coupling head may have a body portion that is manually graspable and manually operable. A torque motor may be housed in the body for driving the drive shaft of the coupling head.

According to a further aspect of the present disclosure, the twist knob of the can opener can be formed with recesses to receive one or more of the engagement member(s) projecting from the coupling head. In this regard, the recesses can be configured to mate with a pair of engagement members of the coupling head in the form of pins that project from the base member.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

Figure 1:
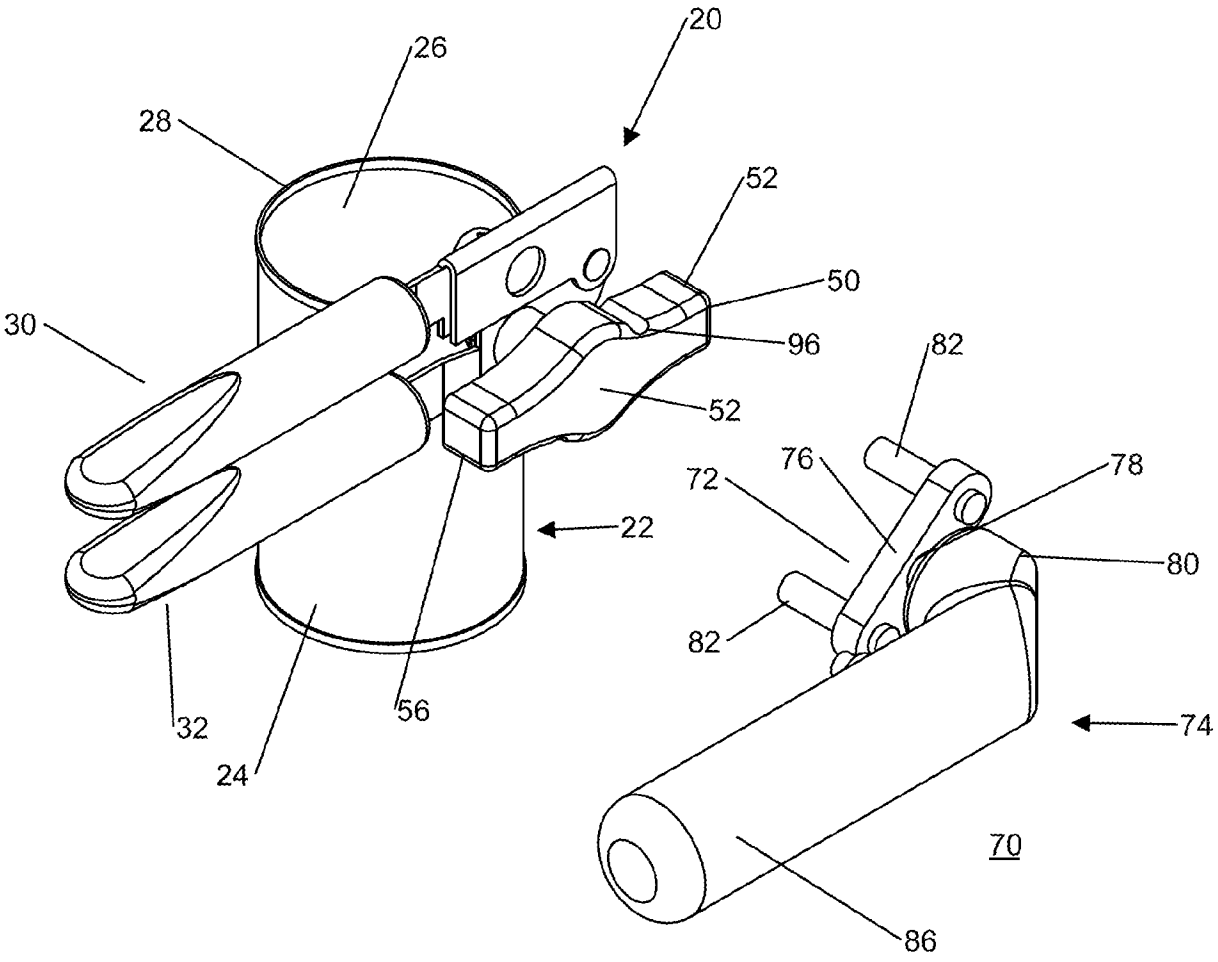
FIG. 1 illustrates one embodiment of the present disclosure, wherein a manual can opener is shown in perspective view as engaged with a can to be opened, and a power assist unit is shown as spaced away from the can opener.
Figure 2A:
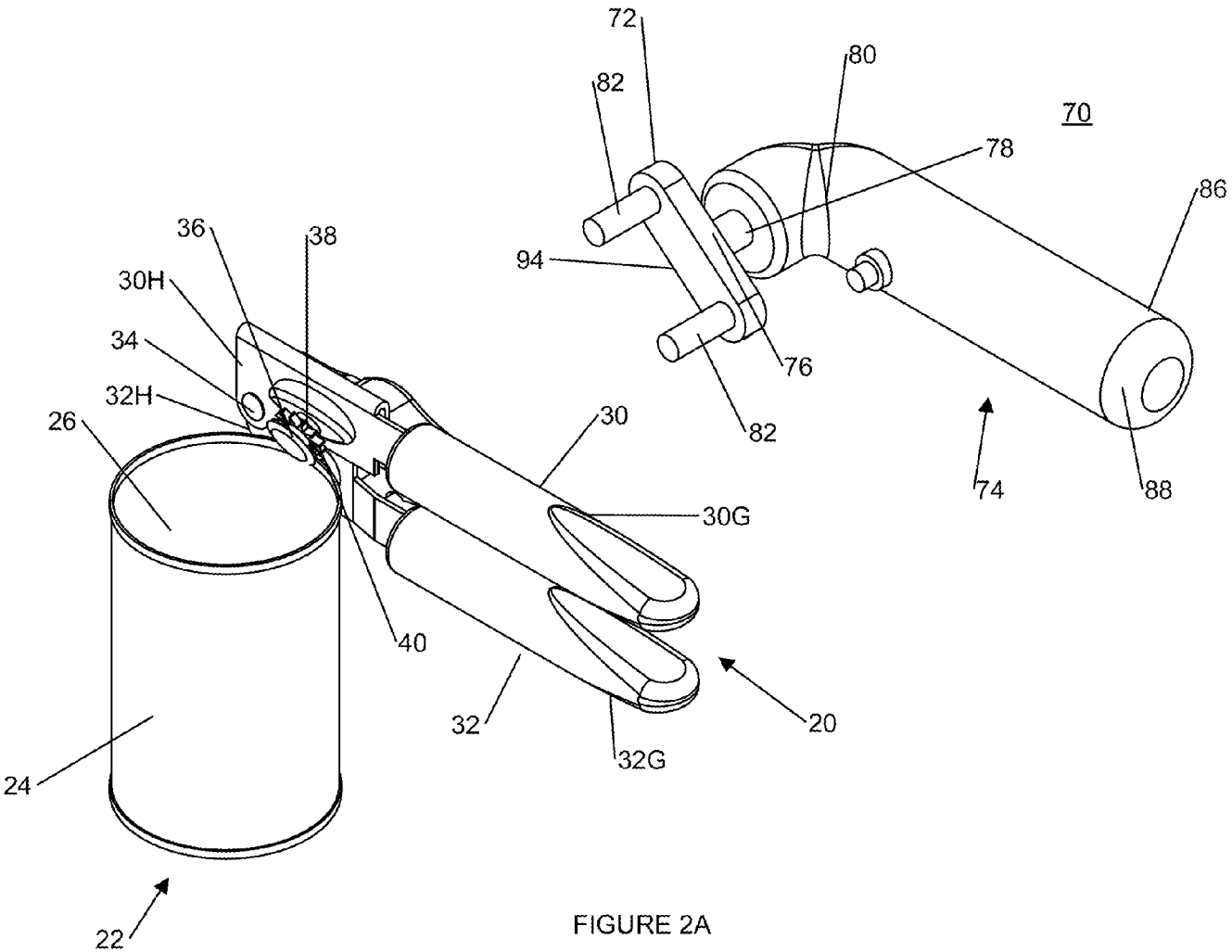
FIG. 2A is a view similar to FIG. 1, but taken from the opposite side of FIG. 1, wherein the can opener is shown in the foreground and the power assist unit is shown in the background.
Figure 2B:
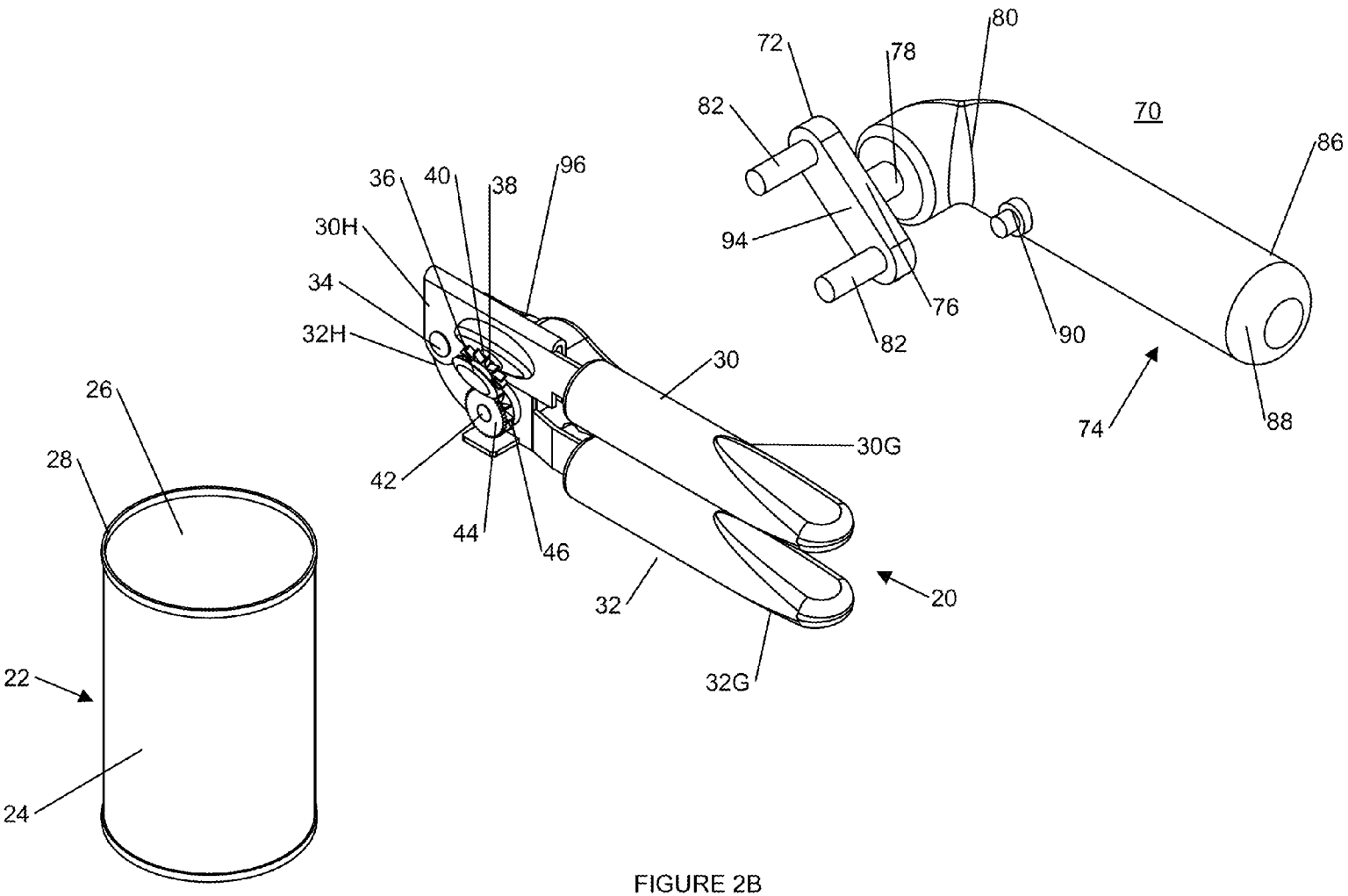
FIG. 2B is a view similar to FIG. 2A, but depicting the can, spaced from the can opener, and power assist unit spaced apart from each other.
Figure 3:
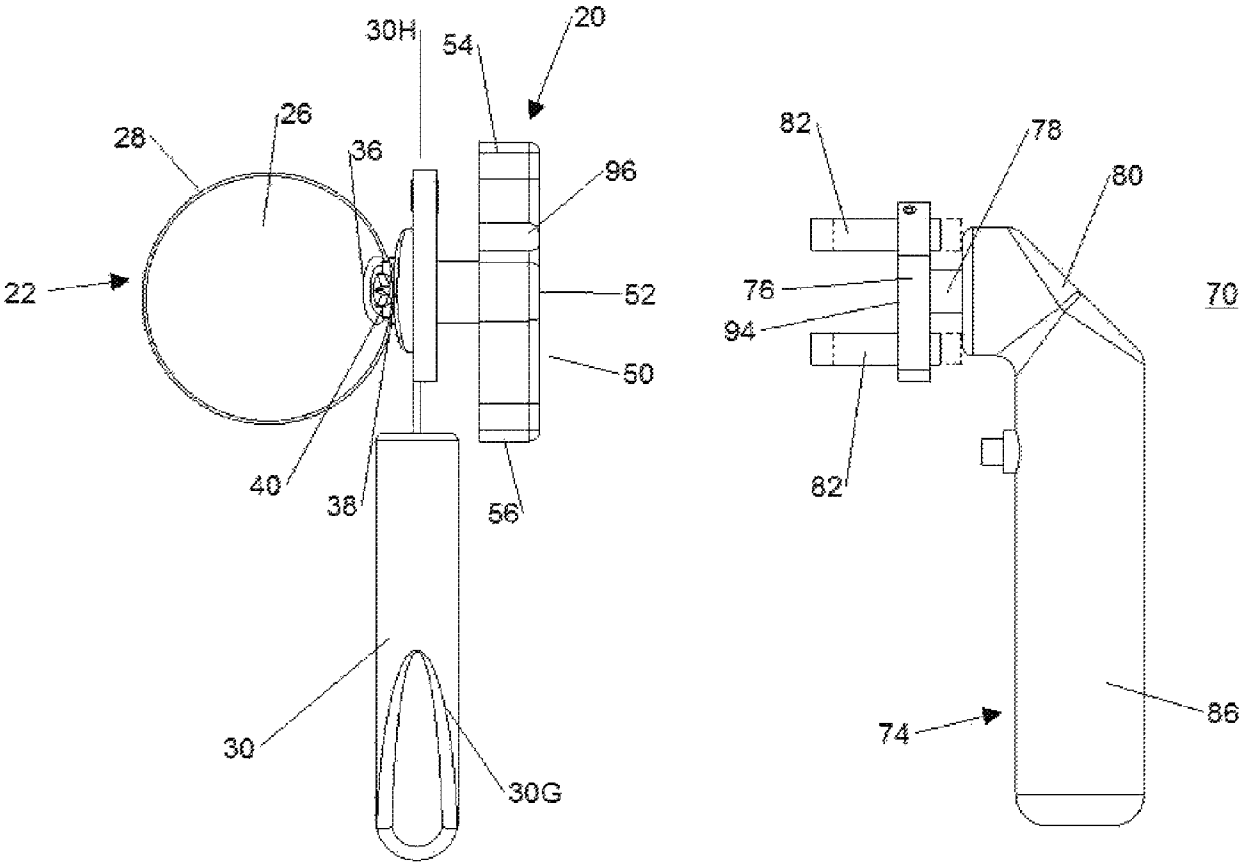
FIG. 3 is a view similar to FIG. 1, showing the can, can opener, and power assist unit in top or plan view.

The description set forth below in connection with the appended drawings where like numerals reference like elements is intended as a description of various embodiments of the disclosed subject matter and is not intended to represent the only embodiments. Each embodiment described in this disclosure is provided merely as an example or illustration and should not be construed as preferred or advantageous over other embodiments. The illustrative examples provided herein are not intended to be exhaustive or to limit the disclosure to the precise forms disclosed.

In the following description, numerous specific details are set forth in order to provide a thorough understanding of exemplary embodiments of the present disclosure. It will be apparent to one skilled in the art, however, that many embodiments of the present disclosure may be practiced without some or all of the specific details. In some instances, well-known method steps have not been described in detail in order not to unnecessarily obscure various aspects of the present disclosure. Further, it will be appreciated that embodiments of the present disclosure may employ any combination of features described herein.

Referring initially to FIGS. 1 through 6, a typical manual can opener 20 is shown as engaged with a can 22 to be opened. The can 22 includes a cylindrical body 24, a round top or cover 26, which is securely attached to the body 24 with an overlapping seam 28. Cans similar to can 22 can be of many various sizes. Moreover, such cans may be cylindrical in shape, in the manner of can 22, but can also be of other shapes, such as oval or even rectangular or square, typically with rounded corners.

The can opener 20 is illustrative of merely one manually operated can opener. It is to be understood that the present invention may be used in conjunction with virtually any type of manual can opener on the market today. Thus, the following description of can opener 20 is not limited to the types of can openers with which the present invention may be utilized.

As shown in FIGS. 1-6, the can opener 20 includes upper and lower handles 32, each having a head portion 30H and 32H, as well as plasticized handle grips 30G and 32G. The head portions of handles 30 and 32 are attached together by a pin 34 extending through aligned openings formed in the forward end portions of the handle head portions 30H and 32H. The pin 34 allows the handles 30 and 32 to be pivoted or rotated relative to each other.

A sharp cutting wheel or head 36 is mounted on the distal end portion of an upper rotatable shaft 38 that projects from head portion 30H. The shaft 38 may project transversely to the plane of head portion 30H or may be canted slightly, so that the shaft 38 extends downwardly at a slight angle to the horizontal as it projects from head portion 30H. The orientation of the shaft 38 places the lower surface of the cutting wheel next to or very close to the seam 28 extending around the top of the can 22.

A gear wheel 40 is disposed on the shaft 38 between the cutting wheel 36 and the adjacent surface of the handle head portion 30H. The can opener 20 also includes a lower shaft 42 that projects from the head portion 32H of the lower handle 32 substantially in vertical alignment with the upper shaft 38. A traction wheel 44, typically composed of a toothed or serrated outer perimeter, is mounted on the distal end portion of the lower shaft 42 in a position just inwardly (toward head portion 32H) of the lower edge portion of the cutting head 36. The traction wheel 44 is positioned to engage against the lower or underside of can seam 28 so as to bite into or grip the seam 28 when the can opener is operated. A second gear wheel 46 is positioned inwardly of the traction wheel and meshes with the upper gear wheel 40.

The lower shaft projects from the lower head 32H on the opposite side to the location of the traction wheel and lower gear wheel. A manually graspable twist knob 50 is mounted on the end portion of the lower shaft. As shown in the Figures, the twist knob includes a central portion 52 engaged with the lower shaft and in oppositely extending projections 54 and 56 that extend from the central portion 52, that are sized to receive the thumb on one end and forefinger and middle finger on the opposite end, to turn the twist knob. When the knob 50 is rotated, the traction wheel 44 rolls along the lower surface of the seam 28 to thereby rotate the can relative to the opener 20. The lower gear wheel 46 meshes with the upper gear wheel 40, thereby to rotate the cutting wheel 36, which severs the can top 26 from the seam 28 in a standard manner.

As will be appreciated, the foregoing description pertains to a wide variety of can openers that are on sale today. One challenge with such can openers is that over time, due to rust, debris, etc., it typically becomes more difficult to rotate the twist knob. In addition, over time and use, the cutting head 36 may become dulled, thus requiring more torque to be applied to knob 50, to cause the cutting head 36 to cut through the can top 26.

The power assist unit 70, shown in FIGS. 1-6, can be employed to rotate the twist knob 50 in a convenient manner. In this regard, the power assist unit 70 includes a coupling head 72 that is rotated or powered by a hand-held power unit 74. The coupling head includes an elongated crossbar 76 connected at its center to torque shaft 78 that projects outwardly from the head portion 80 of the power unit 74. Parallel engagement pins 82 project from crossbar 76 in the direction opposite to the head portion 80. The pins 82 may be engaged with the crossbar 76 by any convenient means, such as by a snug fit, by threads, or other system. As a consequence, the standout of the pins 82 from the crossbar may be adjusted by pulling or pushing on the pins, by rotating the pins, etc. See, for example, FIG. 3. It will be appreciated that the pins 82 are separated far enough from each other to not interfere with head portion 80.

The power unit 74 includes a manually graspable handle section 86, which may be designed to receive batteries for powering the power assist unit 70. A cap 88 may be threadably engaged with the distal end of the handle 86 to gain access to a battery compartment within the interior of the handle 86. A motor (not shown) can be incorporated into either the head portion 80 or the handle portion 86 of the power unit 74.

Appropriate control circuitry is provided to operate the motor at a desired speed. The desired speed may vary according to various factors including, for example, the size of the can being opened, the torque capacity of the specific can opener being used, the strength of the user, the comfort level of the user, etc. It is expected that the torque shaft 78 will rotate at approximately from 30 to 60 revolutions per minute, but of course the speed may be above or below this range. Within this speed range, a user can conveniently control the operation of the power unit 74 and maintain engagement between the power assist unit 70 and the can opener 20. Various methods can be provided to allow the operator to select the desired speed of rotation of the torque shaft 78. For example, a rotatable knob or slide bar (not shown) could be provided on the power unit 74 to allow the user to adjust the speed of shaft 78.

A limit switch or other circuitry or mechanism can be provided so that when not in use, the coupling head 72 of the power assist unit 70 returns to a nominal position similar to that shown in FIGS. 1, 2A, 2B, 4 and 5. This position of the coupling head, and specifically the pins 82, facilitates initial engagement of the coupling head with the twist knob 50.

A push-button switch 90 is provided to operate the power assist unit 70. Of course, other types of switches, such as a slide switch, may be employed in conjunction with the power assist unit 70. Also, reduction gears may be utilized between the electrical motor and the torque shaft 78 to achieve a desired torque level at the shaft 78.

Figure 4:
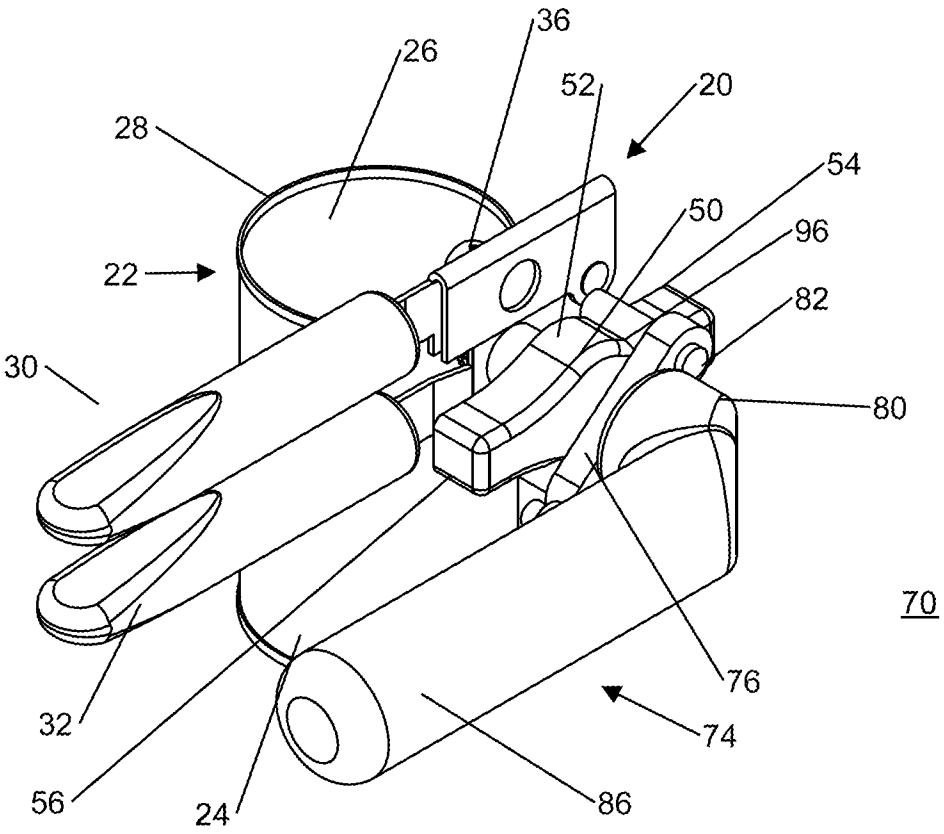
FIG. 4 is a view from the same perspective as FIG. 1, showing the power assist unit engaged with the can opener.
Figure 5:
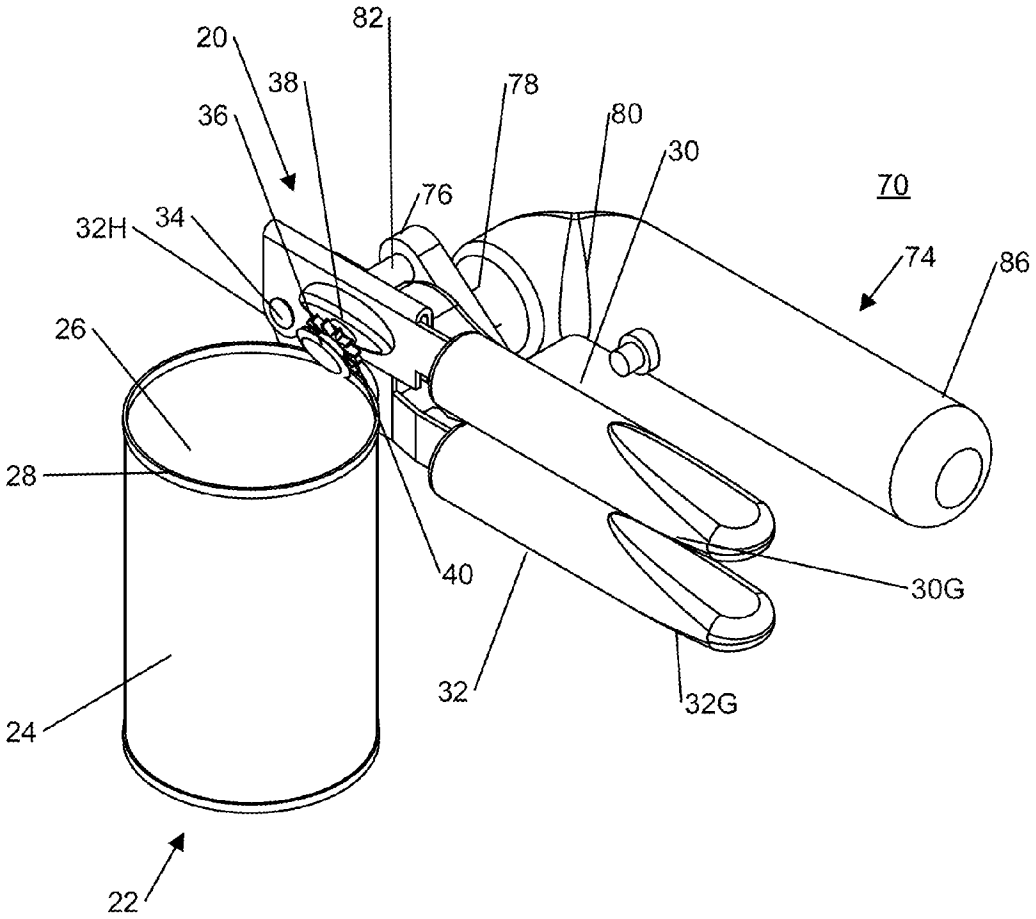
FIG. 5 is a view similar to FIG. 4, but taken from the opposite side of the can as shown in FIG. 4.
Figure 6:
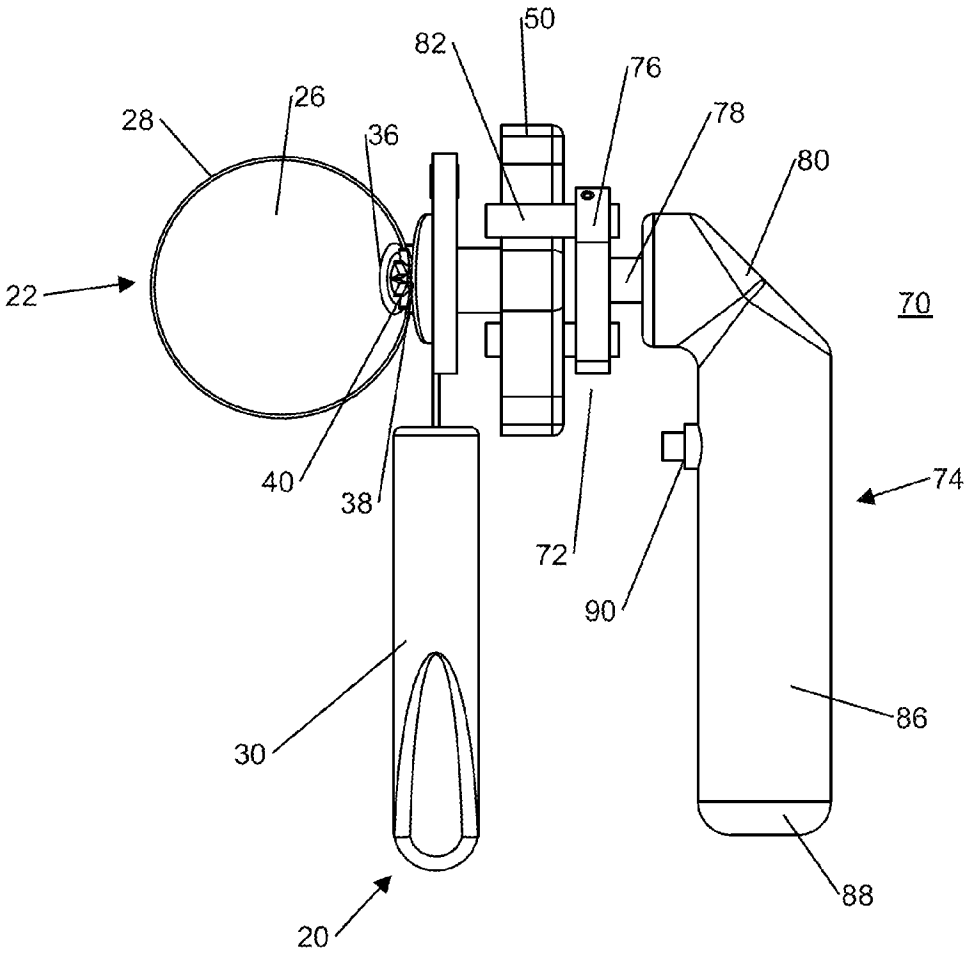
FIG. 6 is a view similar to FIGS. 4 and 5, but taken in top or plan view.
Figure 7:
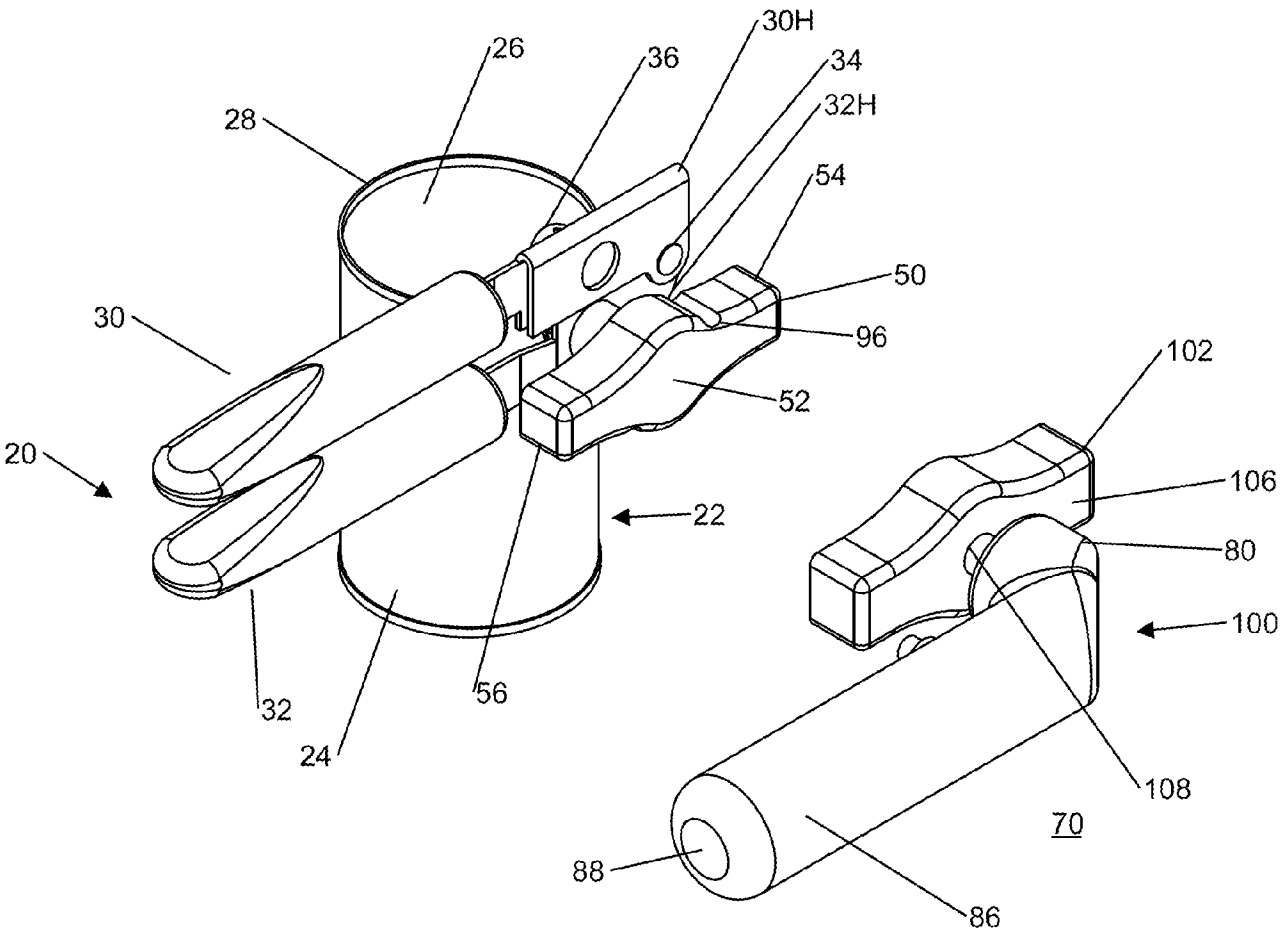
FIG. 7 is an isometric view of a further embodiment of the present disclosure, taken in a perspective view similar to FIG. 1, and showing an alternative manner of engaging the twist knob of a can opener.
Figure 8:
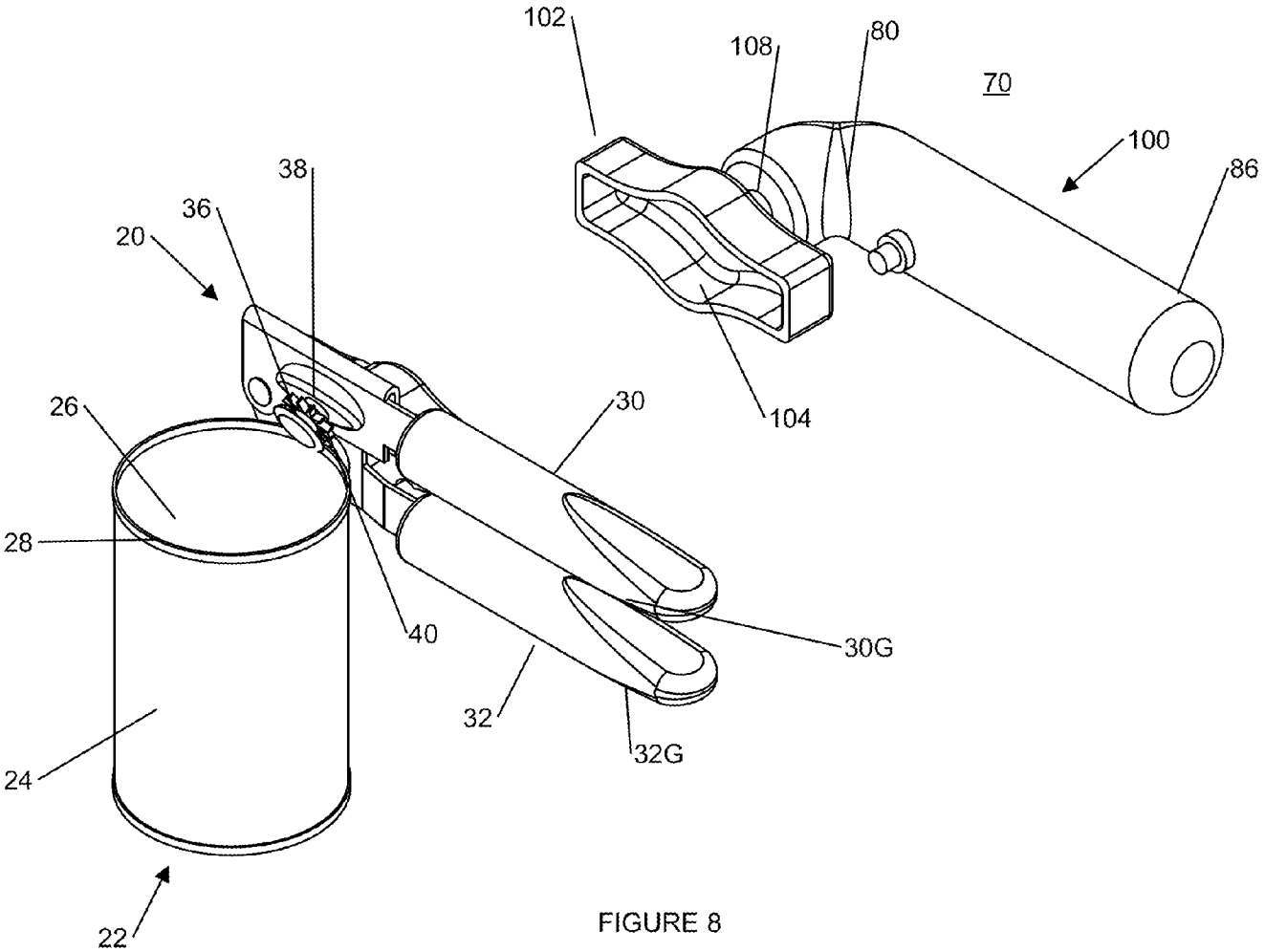
FIG. 8 is a view similar to FIG. 7, but taken from the opposite side of the can from FIG. 7.

In use, a user first engages the can opener 20 with the can 22 so that the handles 30 and 32 are in "closed" position, whereby the cutting head 36 is engaged with the can top 26 and the traction wheel is engaged with the bottom of the can seam 28. This is the position of the can opener 20 shown in FIGS. 1-6. Next, the power assist unit 70 is conveniently positioned so that pins 82 are on opposite sides of twist knob 50, as shown in FIGS. 4, 5, and 6. Thereafter the switch 90 is simply depressed, causing the coupling head 72 to rotate in a clockwise direction as shown in the Figures, which then causes can 22 to rotate relative to the can opener 20 as the cover or top 26 of the can is severed from the can body 24. During the use of the power assist unit 70, one hand of the user can conveniently grip the can opener handles 30 and 32, while the opposite hand can conveniently grasp the handle portion 86 of the power assist unit 70. The pins 82 bear against opposite portions of the twist knob 50 to rotate the twist knob in the clockwise direction. After the cutting head 36 has encircled the can 22, the power assist unit 70 can be switched off and the unit decoupled from the can opener 20, whereupon the coupling head will return to the orientation shown in FIGS. 1, 2A, 2B, 4 and 5.

It will be appreciated that the interaction of the pins 82 with the twist knob 50 causes the coupling head 72 to automatically center with respect to the twist knob. In this regard, the pins 82 tend to slide along the surface of the sides of the twist knobs, thereby to "self center" the coupling head to the twist knob. The sloped surfaces on the side of the twist knob assist in this regard.

In another aspect of the present disclosure, a non-slip material may be applied to the surface 94 of the crossbar 76 facing the can opener 20, so as to provide a non-skid surface to bear against the adjacent side or face of the twist knob when the coupling head 72 is engaged with the twist knob, as shown in FIGS. 4-6. It will be appreciated that in this manner, the power assist unit 70 can conveniently and safely be used to "convert" the can opener 20 into a powered unit.

Although not essential, the twist knob 50 can be formed with indentations or saddles 96, extending transversely across the knob on diametrically opposite sides of the knob. The saddles 96 may be shaped and sized to conveniently and slowly receive pins 82 of the coupling head 72. The use of saddles 96 could add to the security of engagement of the coupling head 72 with the twist knob 50.

Figure 9:
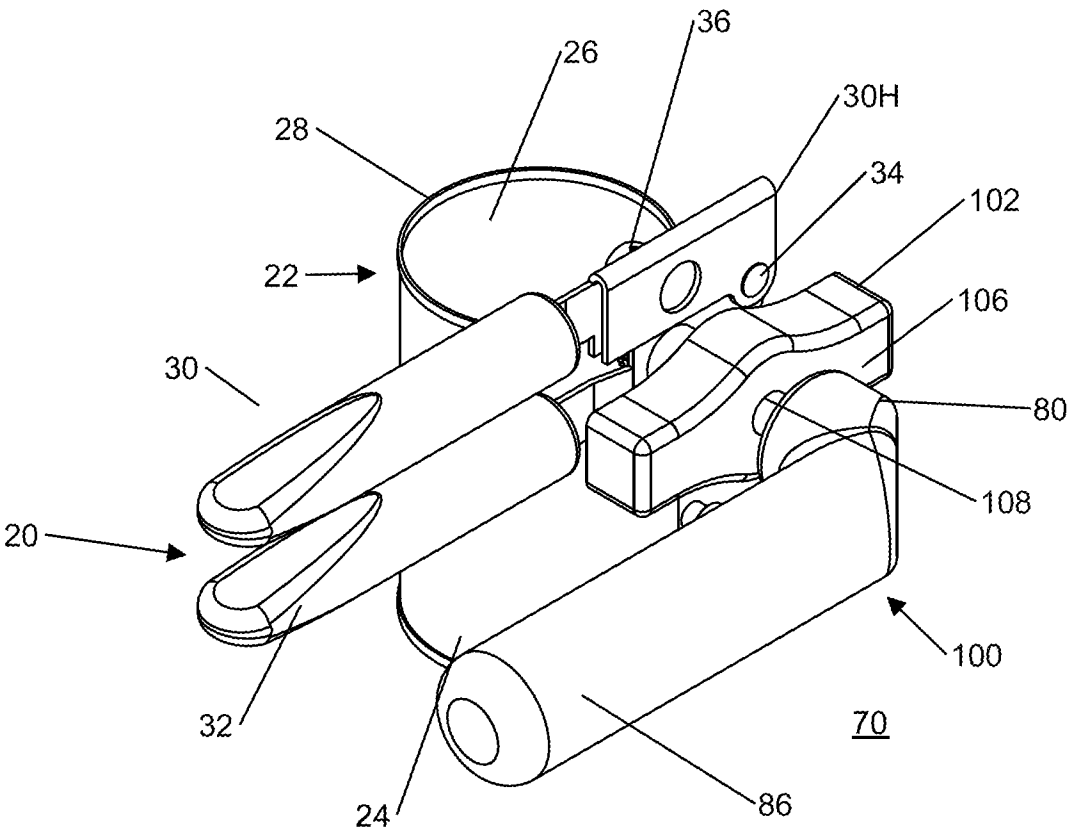
FIG. 9 is a view from the same perspective as FIG. 7, and showing the power assist unit engaged with the knob of the can opener.
Figure 10:
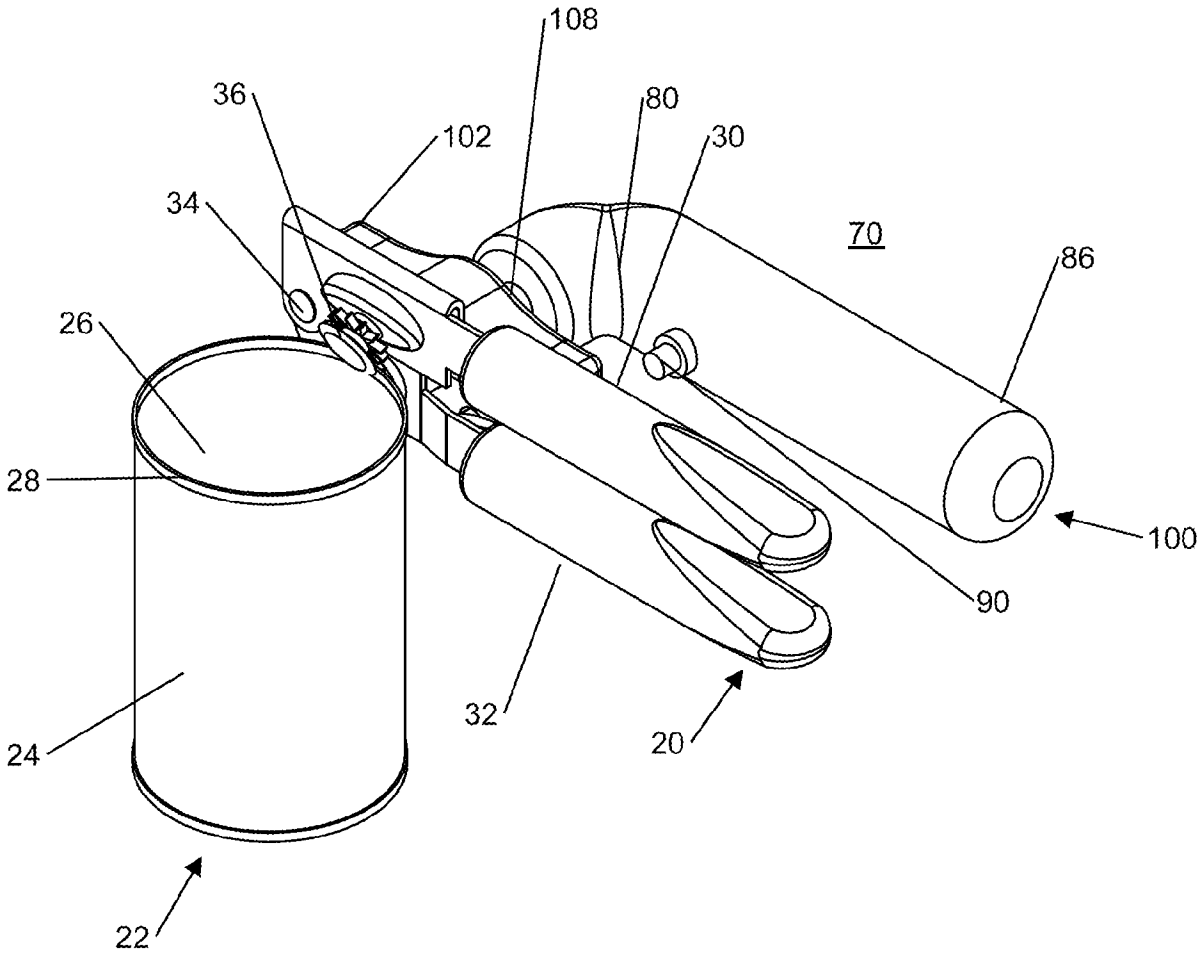
FIG. 10 is a view similar to FIG. 9, but taken from the perspective of FIG. 8.

FIGS. 7-10 illustrate another embodiment of the present disclosure. These Figures show a power assist unit 100 that is constructed very similarly to the power assist unit 70, but wherein the coupling head 72 is replaced with a hollow coupling head 102 that has an interior cavity 104 shaped to match the exterior shape of the twist knob 50 of FIGS. 1-6. The coupling head 102 has a base wall 106 that is attached to torque shaft 108, thereby causing the coupling head to rotate with the torque shaft. A cavity 104 is sized so that the coupling head 102 may be conveniently and closely slipped or engaged over the twist knob 50, as shown in FIGS. 9 and 10. As will be appreciated, the interior surfaces of the coupling head 102 may be coated with a non-slip material to facilitate retention of the coupling head as engaged over the twist knob 50. As will be appreciated, the embodiment shown in FIGS. 7-10 provides a very secure engagement of the power unit 70 with the can opener 20.

As a further aspect of the present invention, various shaped coupling heads, similar to coupling head 102, may be provided so as to match twist knobs 50 of different shapes. In this regard, the coupling head 102 may be detachable from the torque shaft 108 in a convenient manner. For example, a socket may be incorporated into the coupling head 102 to mate with the torque shaft 108 that in turn can be formed in a square, rectangular, pentagonal, hexagonal, oval, partially circular, or other shape, so as to achieve anti-rotational engagement with the coupling head.

Figure 11:
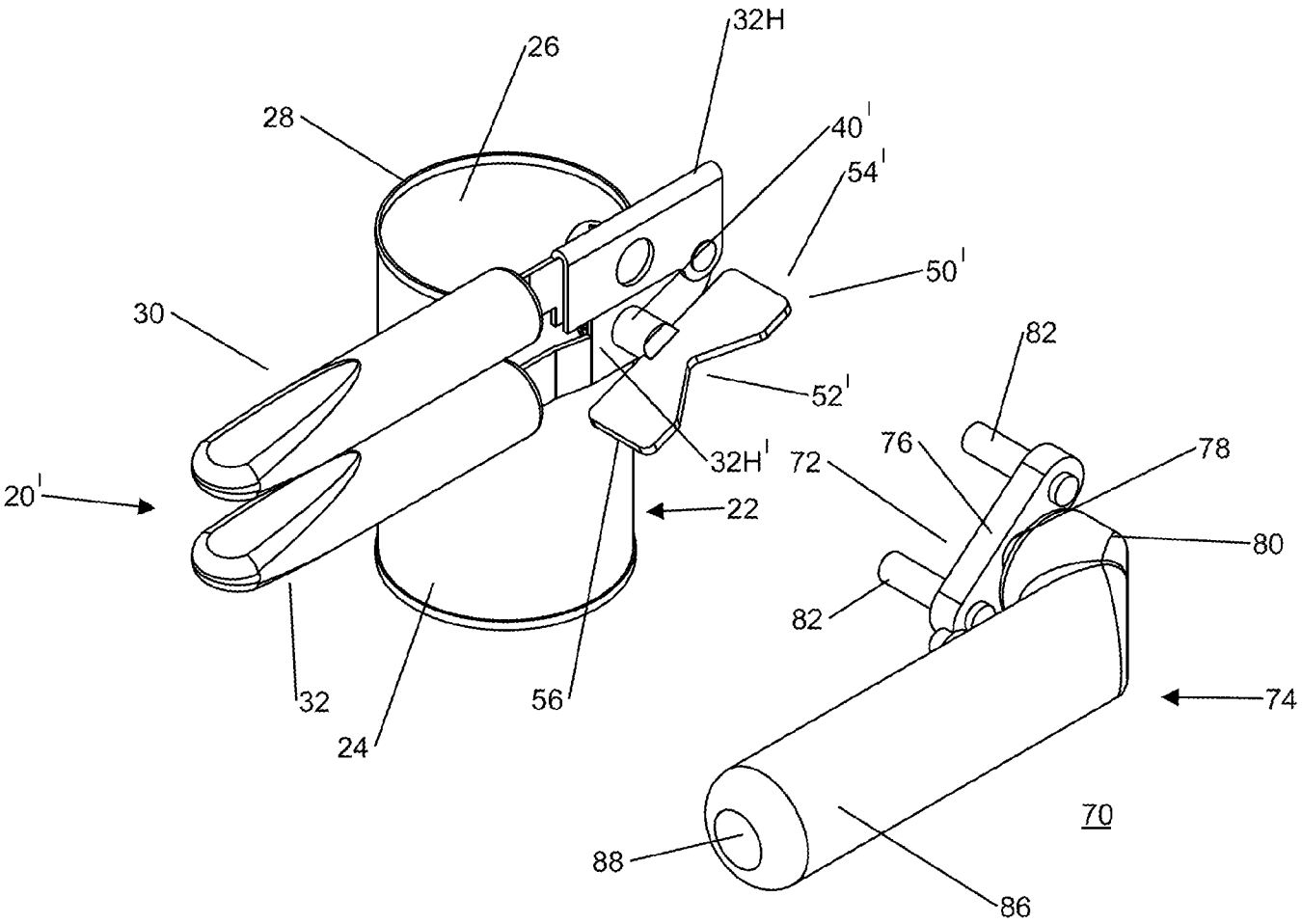
FIG. 11 is an isometric view of a further can opener configuration with respect to which the power assist unit of the present disclosure may be utilized.
Figure 12:
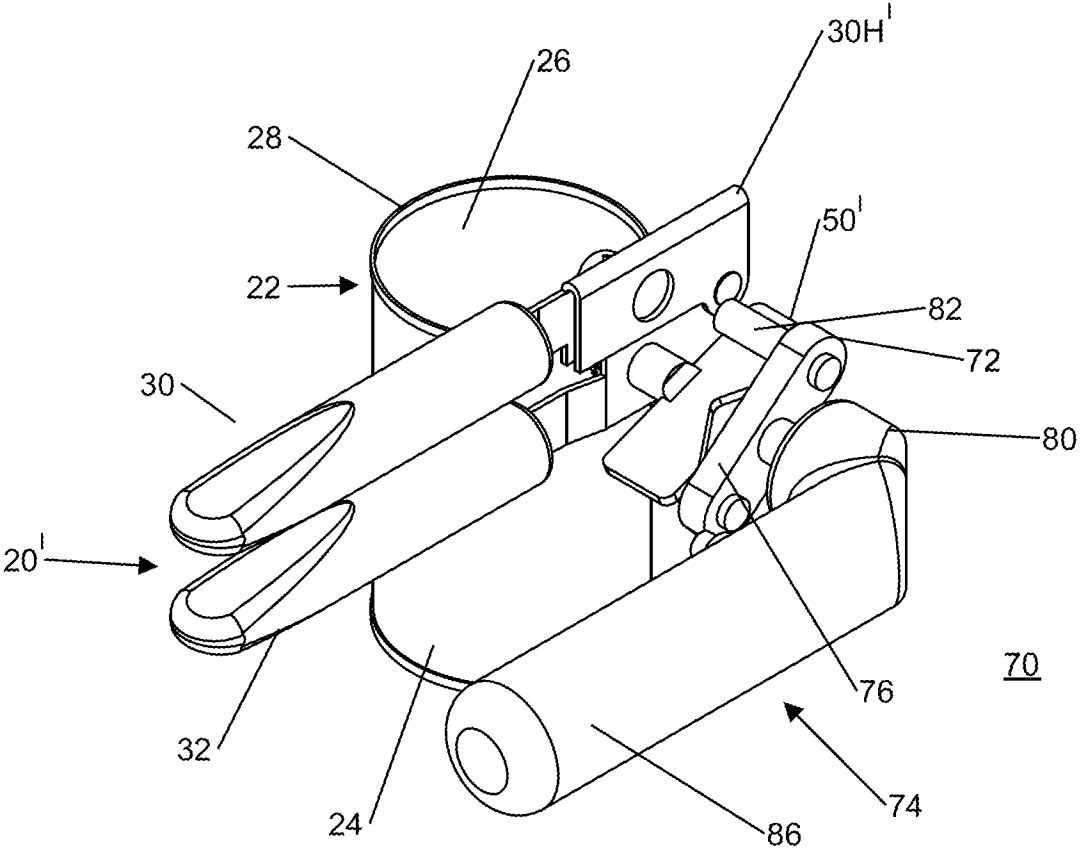
FIG. 12 is a view similar to FIG. 11, and showing the power assist unit engaged with the knob of the can opener.
Figure 13:
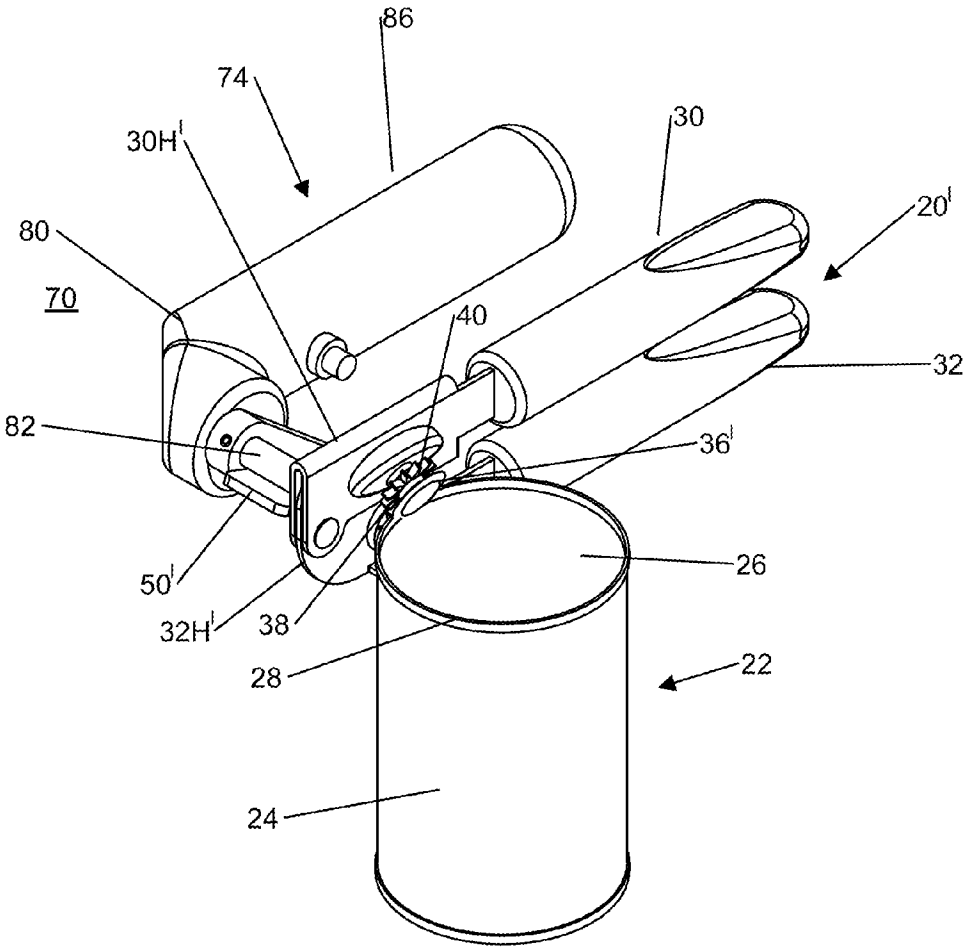
FIG. 13 is a view similar to FIG. 12, but taken from the opposite side of a can being opened.
Figure 17:
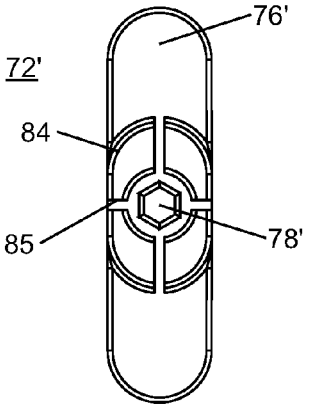
FIG. 17 is a top plan view of FIG. 14.

FIGS. 11-13 illustrate another configuration of a can opener 20' with respect to which the power assist unit of the present disclosure may be conveniently utilized. The can opener 20' is constructed similarly to can opener 20 shown in FIGS. 1-10, with the exception that the can opener 20' utilizes a twist lever 50' of somewhat different configuration than twist knob 50 of can opener 20. As shown in FIGS. 11-13, the twist lever 50' is formed in a generally rectangular, flat relatively thin shape having a straight edge adjacent handles 30' and 32' to engage with shaft 42' centrally along the length of the lever. At the opposite side of the lever, a V-shaped central indentation 52' is formed to provide clearance for portions of the user's fingers when manually rotating the twist lever. As apparent, the components of can opener 20' that correspond with like component of can opener 20 are designated with the same part number, but with the addition of a prime designation.

FIGS. 12 and 13 illustrate the power assist unit 70 engaged with twist lever 50'. As in FIGS. 1-6, the parallel engagement pins 82 of the coupling head 72 bear against opposite sides of the twist lever 50' in a manner quite similar to engagement of the pins 82 with the twist knob 50. Also, as described above, if a non-slip material is applied to the surface 94 of the crossbar 76 of the coupling head 72, such material will help retain engagement of the coupling head 72 with twist lever 50'. As a consequence, the power assist unit 70 may be conveniently utilized to rotate the twist lever 50' in a safe and efficient manner.

FIGS. 14-17 illustrate a further embodiment of the present disclosure, focusing on a particular configuration of coupling head 72'. The coupling head 72' is constructed similarly to coupling head 72, but is not permanently attached to a torque shaft such as torque shaft 78. The components and features of coupling head 72' that are similar or the same as coupling head 72 are identified with the same part number, but with a prime "'" designation.

Briefly, coupling head 72' includes an elongated crossbar 76' which is rounded at its ends in the manner of crossbar 76. A pair of engagement pins 82' project from the crossbar 76 at spaced apart locations sufficient to straddle a twist knob of a can opener, for example, twist knob 50 or 50' described above.

The coupling head 72' also includes a torque shaft 78' that is shaped and sized to engage with a socket or other torque transferring source. In this regard, the torque shaft 78 is shown as shaped as a hexagon to correspond to the shape of a typical socket that may be driven by a powered torque source, for example, a powered screw driver, a powered drill, etc. Of course, the torque shaft 78' may be in numerous other shapes to correspond to the socket or other torque source coupled to the torque shaft. Such shapes include, for example, triangular, square, pentagonal, oval, octagonal, partially circular, etc.

Figure 14:
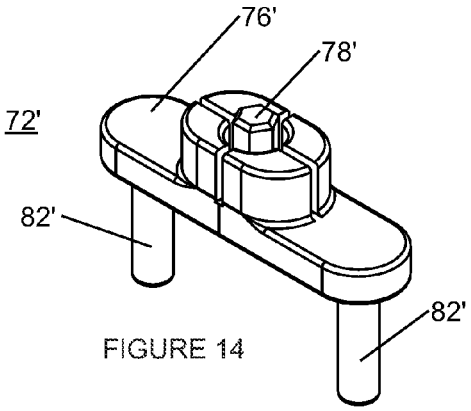
FIG. 14 is an isometric view of a further embodiment of the present disclosure pertaining to a coupling head.
Figure 16:
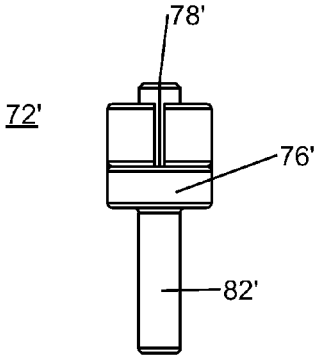
FIG. 16 is an end elevational view of FIG. 14.
Figure 15:
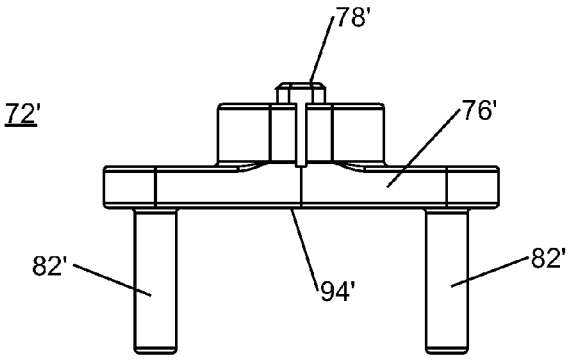
FIG. 15 is a side elevational view of FIG. 14.

As shown in FIGS. 14-16, a circular collar 84 surrounds the torque shaft 78'. The purpose of the collar is to help retain the socket engaged with the torque shaft 78'. The collar 84 is useful for retaining certain types of drills in engagement with the torque shaft 78'. Certain small, low rpm drills do not utilize an adjustable chuck. Rather, the drills are constructed with a simple round, cylindrical tip having a hex-shaped cavity therein for receiving a tool tip, for example a socket, screwdriver head, etc. Typically, the base of the cavity is magnetized to hold the tool tip in place. The collar 84 is designed to surround and engage the cylindrical tip of the drill to retain it engaged with the torque shaft 78'.

As shown in FIGS. 14-17, the collar 84 is constructed with slots 85 formed at 90 degrees about the collar. The purpose of the slots is to provide a certain amount of flex or movement in the collar so as to accommodate differences in the outer diameters of the drill tips.

Moreover, it will be appreciated that the collar 84 makes it realistic to utilize attachments, such as sockets, for drills made from non-magnetic materials, such as injection-molded plastics. In those situations the attachment tool is interposed between the drill tip and the torque shaft 78'.

It will be appreciated that the coupling head 72' may be utilized with the same types of can openers such as can openers 20 and 20' described above. Moreover, the coupling head 72' can be powered by numerous different devices, as noted above, including battery-powered screwdrivers, drills, or other apparatus or appliances that have a rotational output. An appropriate adaptor or socket can be interposed between the output of the appliance or apparatus and the torque shaft 78' of the coupling head 72' shown in FIGS. 14-17. Or the drive tip of the appliance or apparatus may be directly engageable with the torque shaft 78'.

While illustrative embodiments have been illustrated and described, it will be appreciated that various changes can be made therein without departing from the spirit and scope of the invention.

For example, the present disclosure contemplates removal of the twist knob from the manual can opener and then engagement of the torque source with the shaft from which the twist knob has been removed. Of course it may be necessary to use a connection between the shaft from which the twist knob has been removed and the torque source. A torque source, for example, a handheld drill or other appliance, may be configured so that its output shaft mates directly with the shaft from which the twist handle has been removed.

As a further example, the twist knob can be formed with a central socket coincident with the location of the rotational axis of the twist knob. The socket can be shaped and sized to receive the tip of a drill or other appliance or a tool tip that is held by the drill or other appliance. In this regard, the tip of the drill or other appliance or the tool tip functions as a coupling head to transfer the torque from the drill or appliance to the twist knob.

The embodiments of the invention in which an exclusive property or privilege is claimed are defined as follows:

1. A coupling head to couple a torque source to a manual can opener operated by a twist knob connected to a cutting wheel to cut the lid of a can from a can body by rotation of the twist knob, said coupling head comprising:

(a) a base member to overlie at least a portion of the twist knob;

(b) one or more engagement members projecting generally laterally from the base member and engageable with portions of the twist knob, wherein said one or more engagement members are selected from the group consisting of:

a pair of spaced apart circular pins that project from the base member, and one or more portions projecting from the base member, said one or more portions closely matching the shape of at least a portion of the outer perimeter of the twist knob to closely engage over the twist knob;

(c) a drive shaft projecting from the base member in a direction opposite to the one or more engagement members, said drive shaft capable of receiving drive torque to rotate the coupling head to in turn rotate the twist knob of the can opener; and (d) wherein:

the drive shaft is configured to receive a drive socket; and a collar surrounds the drive shaft to press against the drive socket.

2. The coupling head according to claim 1, wherein said pins are spaced apart far enough from each other to bear against opposite sides of the twist knob for rotation of the twist knob.

3. The coupling head according to claim 2, wherein the distance that the pins project from the base member may be selectively varied.

4. The coupling head according to claim 2, wherein the drive shaft is positioned centrally between the pins.

5. The coupling head according to claim 1, wherein the engagement member is shaped to extend around the outer perimeter of the twist knob.

6. The coupling head according to claim 1, wherein the drive shaft is of a shape selected from the group consisting: of triangular, rectangular, square, pentagonal, hexagonal, oval, and partially circular.

7. In combination:

(a) a manual can opener operated by a twist knob connected to a cutting wheel to cut the lid of a can from the can body applying a torque to the twist knob to rotate the twist knob;

(b) a coupling head to couple a source of torque to the twist knob, the coupling head, comprising:

(i) a base member to overlie at least a portion of the twist knob; and (ii) one or more engagement members projecting generally laterally from the base member and engageable with portions of the twist knob, wherein the one or more engagement members are selected from the group consisting of:

a pair of circular pins that project from the base member; and one or more portions projecting from the base member shaped to match the exterior shape of at least a portion of the twist knob, thereby to engage over the twist knob;

(c) a drive shaft projecting from the base member in a direction opposite to the one or more engagement members, said drive shaft capable of receiving drive torque to rotate the coupling head to in turn rotate the twist knob of the manual can opener; and (d) wherein:

the drive shaft is configured to receive a drive socket; and a collar surrounds the drive shaft to press against the exterior of the drive socket.

8. The combination according to claim 7, wherein the can opener twist knob having recesses formed therein to receive the circular pins that project from the base member.

9. The combination according to claim 7, wherein the coupling head projecting portion comprises a cavity closely matching the shape of the twist knob to engage over the twist knob.

* * * * *